US005629005A

United States Patent [19]

Brassington et al.

[11] Patent Number: 5,629,005

[45] Date of Patent: May 13, 1997

[54] ABSORBENT MATERIAL AND A METHOD OF MAKING SAME

[75] Inventors: Nigel J. Brassington, Les Spa; Jean Welburn, Saltburn-by-the-Sea, both of England

[73] Assignee: British United Shoe Machinery Limited, England

[21] Appl. No.: 615,150

[22] Filed: Mar. 14, 1996

Related U.S. Application Data

[63] Continuation-in-part of Ser. No. 318,788, filed as PCT/GB93/00897 Apr. 29, 1993.

[30] Foreign Application Priority Data

May 1, 1992 [GB] United Kingdom ..... 9209463

[51] Int. Cl.[6] ..... A61L 15/22

[52] U.S. Cl. ..... 424/402; 442/361; 442/403; 442/415

[58] Field of Search ..... 428/298; 424/402

[56] References Cited

U.S. PATENT DOCUMENTS

| | | | |
|---|---|---|---|
| 4,537,822 | 8/1985 | Nanri et al. | 428/298 |
| 4,761,322 | 8/1988 | Raley | 428/298 |
| 4,804,378 | 2/1989 | Shiba et al. | 428/298 |
| 4,857,065 | 8/1989 | Seal | 428/298 |
| 4,892,534 | 1/1990 | Datta | 428/298 |
| 5,104,703 | 4/1992 | Rachman | 428/298 |
| 5,217,782 | 6/1993 | Moretz | 428/298 |

FOREIGN PATENT DOCUMENTS

| | | | |
|---|---|---|---|
| 0388062 | 9/1990 | United Kingdom | 428/298 |
| 0388072 | 9/1990 | United Kingdom | 428/298 |

*Primary Examiner*—Thurman K. Page
*Assistant Examiner*—Murthy V. Sikha

[57] ABSTRACT

An absorbent material suitable for use as a medical or hygienic absorbent and comprises a non-woven fibre sheet having dense surface layers 10 and between these layers a less dense region where most of the fibres extend in the plane of the sheet. Transversely extending fibres 16 help to bind the material, the fibres also being bonded to some extent by a hot melt bonding material, e.g. core/sheath-type bi-component fibres. The material is made by forming a blend of fibres, including a minor weight of hot melt fibres, by cross-lapping a plurality of layers 14 to form a web, subjecting the web to needling at low punch density with penetration through the web, thereafter subjecting surface regions 10 of the web to higher punch density needling to form the dense surface layer 10 at each face from the web. The web is then heated, e.g. by high temperature air, to soften the hot melt material and to cause it to bond adjacent fibres while retaining its fibrous form and without significant shrinkage of the web as a whole.

12 Claims, 1 Drawing Sheet

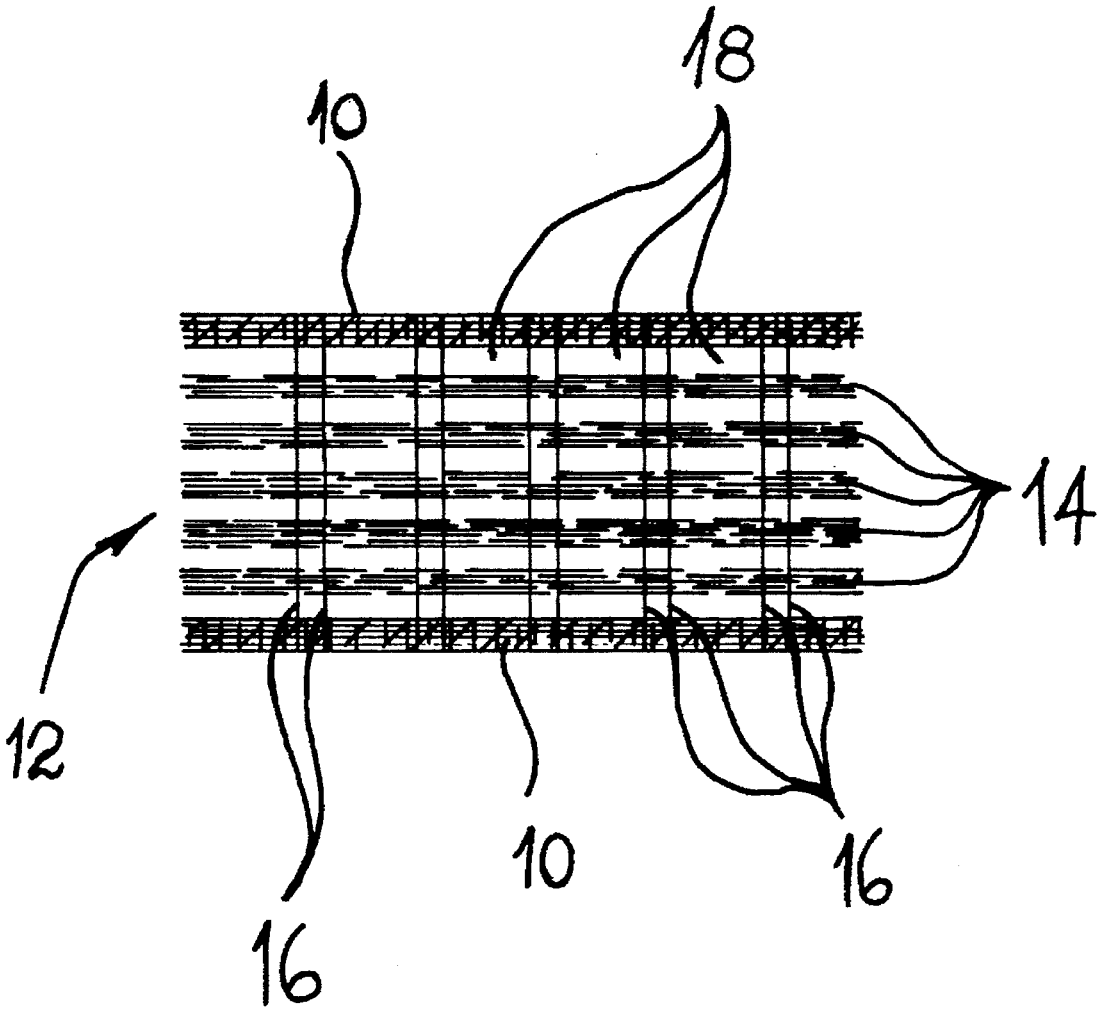
18
10
14
12
10
16
16

ABSORBENT MATERIAL AND A METHOD OF MAKING SAME

This is a continuation-in-part of U.S. patent application Ser. No. 08/318,788 filed as PCT/GB93/00897 on Apr. 29, 1993, now pending.

TECHNICAL FIELD

This invention is concerned with an absorbent material and method for making same and is especially concerned with absorbent materials suitable for use in medical or hygienic absorbance for the absorption of body fluids, for example in surgical dressings, sanitary products and incontinence products.

BACKGROUND OF THE INVENTION

There are described in EP-A-0 388 062 various absorbent materials of the type comprising a non-woven fibre sheet having a dense surface layer of fibres at each face of the sheet and, between the surface layers, a relatively low density region which, apart from an initial "tacking" operation, has not been subjected to any substantial needling. More particularly the preferred materials there described each comprise at least a major proportion of hydrophilic fibres, although there is also a passing reference therein to the possibility of producing absorbent material entirely of hydrophobic fibres. The preferred materials described in said specification utilised in particular a mixture of hydrophilic and hydrophobic fibres, the hydrophilic fibres serving to absorb fluids while the hydrophobic fibres provided a "scaffolding" for retaining the structure of the low density region, even under compression. In the case of the wholly hydrophobic fibre material, the fluid is believed to have been effectively "stored" within the structure rather than being absorbed into the fibres themselves.

Although the absorbent materials described in detail in said specification have in practice proved generally satisfactory, nevertheless when fluid has been absorbed by the hydrophilic fibres in the web there arises a tendency in these hydrophilic fibres to collapse, especially under compression, so that although the use of hydrophilic fibres is believed to enhance absorbency, absorbent webs including hydrophilic fibres may tend to collapse and thus have a less than optimum absorbency and may even "wet back" when a load is applied, that is the absorbed fluid may be forced out of the material by the pressure.

OBJECTS OF THE INVENTION

It is one of the various objects of the present invention to provide an improved absorbent material in which the disadvantages of currently available materials are mitigated.

It is a further one of the various objects to provide an improved method of producing such materials.

SUMMARY OF THE INVENTION

An absorbent material comprising a non-woven fibre sheet having a plurality of relatively distinct layers, said non-woven sheet being arranged to have at each face a surface layer and have a region of said absorbent material therebetween, each surface layer having a higher compactness of fibres compared to the region of said absorbent material therebetween and thus each said surface layer being of a higher density than the region of said absorbent material therebetween, said higher compactness of fibres in each said surface layer being maintained by higher tack entanglement between fibres as compared to said region of said absorbent material therebetween where the substantial majority of fibres remain in a plane parallel of the sheet, said absorbent material being formed from a blend of fibres including a proportion of hydrophobic fibres and a proportion of activated fibrous bonding agent, said hydrophobic fibres and said activated fibrous bonding agent adhering together in a resilient voluminous structure resistant to percussive pressure, said voluminous structure having air spaces between said fibres arranged to hold liquid despite such percussive pressure.

The invention further provides, in another of its several aspects, a method of making an absorbent material comprising forming a non-woven fibre web comprising a blend of fibres including a minor weight of heat-activated bonding agent in fibrous form, subjecting the web to needling at a low punch density with the needles penetrating completely through the web, then subjecting surface regions of the web to needling at a much higher punch density whereby to form a dense surface layer of fibres at each face of the web, and thereafter subjecting the web to heat in such a manner as to activate the bonding agent and cause it to bond to adjacent fibres but without destroying its fibrous structure and without substantially affecting the other fibres of the web and without causing significant shrinkage.

In the material and the method in accordance with the invention set out respectively in the last two preceding paragraphs the bonding agent preferably comprises a hot melt bonding agent. In a preferred embodiment, moreover, the bonding agent is originally (i.e. prior to melting) constituted by one component of a bi-component fibre, preferably of the core/sheath type, in which said one (the sheath) component has a lower softening point than the other (core) component, the latter remaining in fibrous form after heat activation of the one component. However, other suitable bonding agents may be used provided that their fibrous form is retained after bonding; for example a fibre component having a fairly low melting point relative to the other components, e.g. polyethylene or polypropylene single component fibres, may be used but will require careful control of bonding conditions during manufacture to ensure sufficient heating to effect bonding whilst still not destroying their fibrous nature.

Preferably, in carrying out a method in accordance with the invention to produce absorbent materials in accordance with the invention, a light non-woven fibre web is produced continuously by known methods, for example using carding techniques, and the light web so produced is cross-lapped to provide a web with a plurality of layers; preferably the web has between 4 and 40 layers, more preferably between 6 and 20 layers, and most preferably between 8 and 14 layers. The web is then tacked completely through by subjecting the web to a needling operation at a low punch density suitably between ½ and 20 per $cm.^2$, preferably between 1 and 8 per $cm.^2$ and most preferably at a punch density of between 2 and 6 per $cm.^2$. Surface regions of the web are thereafter subjected to needling at a much higher punch density, suitably between 100 and 1,000 per $cm.^2$, preferably between 200 and 600 per $cm.^2$ and more preferably between 300 and 500 per $cm.^2$, to form a dense surface layer of fibres at each face of the web. The high density needling may conveniently be arranged to penetrate each surface of the web to no more than 15% of the thickness of the web prior to that needling, for example to a depth of not more than 0.5 mm.

In carrying out a preferred method in accordance with the invention, the fabric is subjected to heat by suitably blowing hot air through the web in sufficient volume and for a sufficient period of time to soften the bonding agent, e.g. a sheath component where a bi-component core/sheath fibre is used, without having any substantial effect on the remainder of the fibres in the web and without causing any significant shrinkage of the web. It is important that the air flow does not collapse the web or reduce its thickness to any significant degree. In a preferred embodiment, using a bi-component fibre of the core/sheath type, where the core component has a softening point of about 220° C. and the sheath a softening point of about 100° C., it has been found sufficient to subject the web to a flow of air at about 175° C. for a period of about 1 minute. If desired, after the hot air treatment the web may be subjected to surface rolling suitably carried out at an elevated temperature similar to that of the hot air, conveniently by passing the web between rolls set at a fixed gap; such gap would preferably be fixed to be not less than 70% of one thickness of the web prior to passing through the gap. Such hot rolling will tend to provide an absorbent material with a relatively smooth and lint-free surface which is important in some applications. Cold rolling of the web, using a fixed gap may, however, be useful in some circumstances as this tends to lead to more rapid setting of a hot-melt component which may lead to a somewhat stronger but less absorbent product.

In the manufacture of material in accordance with the invention, preferably the web is formed from a blend of coarse and fine deciTex fibres, the coarse deciTex fibres suitably having a deciTex between 5 and 15, preferably between 5 and 7 deciTex, and the fine deciTex fibre suitably being less than 3 deciTex. The fibres of the bonding agent are preferably fine fibres. The coarse fibres suitably comprise 5 to 40% of the blend, preferably 10 to 30% of the blend and more preferably 15 to 25% of the blend by weight, the balance being fine fibres. In one preferred material the fibre blend suitably includes 2 to 50% of fine bi-component fibre of the core/ sheath type in which the sheath has a lower softening point than the core, preferably 3 to 20% and more preferably 5 to 10% by weight. In such blend, furthermore, three fibres are used, preferably all being polyester fibres, namely a major proportion of a fine single component polyester fibre providing a basic structure of the fabric, a major proportion of the remainder of the fibre being a coarse single component polyester fibre and the balance of the fibre being a fine bi-component polyester fibre of the type referred to.

Appropriate fibre lengths must also be selected and these will depend to some extent on the processing techniques to be utilised. Fibre lengths between 20 mm. and 120 mm. may be suitable, preferably between 25 mm. and 90 mm. and more preferably between 30 mm. and 70 mm.

In a preferred method in accordance with the invention the web weight before subjecting the web to heat is between 70 and 1,000 grammes per square metre, preferably between 80 and 600 grammes per square metre and more preferably between 100 and 400 grammes per square metre. When subjecting the web to heat treatment the change in area of the web is suitably no more than plus or minus 10%, preferably no more than plus or minus 5% and most preferably 0%. The reduction in thickness of the web after heat treatment (and rolling where used) is preferably between 0 and 40% and more preferably between 5 and 20%.

Although materials containing hydrophilic fibres exhibit improved absorbency and strength when produced by a method in accordance with the present invention, it is preferable that the materials in accordance with the invention are constituted wholly by hydrophobic fibres, more particularly fibres which are inherently hydrophobic throughout. Fibres which have been rendered hydrophobic by applying a surface coating are generally less suitable, especially where the coating tends to interfere with bonding.

In another aspect the invention may be considered to provide an absorbent material comprising a non-woven fibre sheet substantially of hydrophobic fibres, the sheet having a dense surface layer of fibres at each face of the sheet and, between the surface layers, a relatively lower density region in which a substantial majority of the fibres extend generally in the plane of the sheet and a small number of fibres extend in a direction generally transverse to the plane of the sheet, the transversely extending fibres having been substantially produced by needle punching at a low punch density and the surface layers having been formed by needle punching at a high punch density.

There now follows a detailed description to be read with reference to the accompanying drawing of an absorbent sheet material embodying the invention and a method of making same, itself embodying the invention in its method aspects. It will be realised that this material and method have been selected for description to illustrate the invention by way of example.

BRIEF DESCRIPTION OF THE DRAWING

The accompanying drawing is a diagrammatic view in section of a portion of an absorbent material embodying the invention.

DESCRIPTION OF THE PREFERRED EMBODIMENT

The illustrative material comprises a non-woven sheet having a dense surface layer (10) of fibres at each surface and, between the surface layers (10), a relatively lower density region in which a substantial majority of the fibres extend generally in the plane of the sheet. This lower density region (12) comprises a plurality of layers (14) formed by cross-lapping as hereinafter described. A small number of fibres (16) extend in a direction generally transverse to the plane of the sheet, the transversely extending fibres (16) having been produced, in the manufacture of the illustrative absorbent material, by needle punching at a relatively low punch density and the relatively dense surface layers (10) having been formed by needle punching at a higher punch density. The fibres of the absorbent material are bonded together to some extent by a hot melt bonding material originating as a sheath component of a core/sheath type bi-component fibre, the core component remaining in fibrous form in the finished sheet. Methods of manufacturing the illustrative absorbent material referred to above are set out in the following examples.

EXAMPLE I

The following blend of three fibres was used:

76% by weight 1.7 dTex hydrophobic polyester. This fine dTex fibre provides the basic structure of the fabric, giving rise to a large number of interstices. It also provides loft and softness to handle. The particular fibre used was Trevira type 290, which has a melt temperature of 230° C.

19% by weight 5.0 dTex hydrophobic polyester. This coarse dTex fibre is arranged within the absorbent material to provide scaffolding, i.e. to act as a structural element which will tend to oppose any mechanical forces acting on the fabric. The particular fibre used was also Trevira type 290.

5% by weight Fine dTex (about 2.2 dTex) bi-component core/ sheath polyester, the melt temperature of the core being about 220° C. and of the sheath about 120° C. The particular fibre used was Trevira type 252.

Alternatively, between 20–30% of the material blend may be a hydrophilic fibre such as viscose with appropriate scale reduction in the constituent fibre percentages outlined above.

These fibres were blended in the stated proportions prior to being processed through high-efficiency cards to produce an open web of about 12 grammes per square metre. This resultant web was then cross-lapped to give a web with 11 laps (layers).

The web formed by cross-lapping these layers was then tacked completely through using a needle punch density of approximately 4/cm.$^2$. High efficiency 40 gauge tacking needles were used. This reduced the loft of the web considerably and provided fibres in the direction generally transverse to the plane of the web which held the layers together.

The resultant tacked web was then needled through two looms, in such a way that the needle barbs had a significant densifying effect only at the surfaces of the webs, i.e. low needle penetrations were used. High efficiency 40 gauge needles were used throughout. Loom 1 provided a needle punch density, on the top surface only, of 120/cm.$^2$. Loom 2 provided a needle punch density, on both top and bottom surfaces, of 180/cm.$^2$. The penetration for the lower needles used on loom 2 was slightly greater than the top needle penetration, to compensate for the top surface needling on loom 1. The intention was to provide a web with top and bottom surfaces substantially equally densified. The web at this stage had a weight of about 170 grammes per square metre and a loft of around 4 mm.

The web was then through-air bonded before being very lightly surface-rolled. The through-air bonding was carried out at 175° C. with an air flow of 132 m/min and a dwell time of 1 min. This air flow was such that the bi-component fibre rapidly reached the melt temperature of its sheath component without causing significant shrinkage and without collapsing the web or reducing its thickness significantly. The area change through the heat treatment process was about +4%. The subsequent surface rolling was carried out at 175° C. using heated rolls set 3 mm. apart. After rolling the fabric was rapidly cooled by drawing cold air through the web. The fabric at this stage had a weight of 165 grammes per square metre and an unconstrained thickness of around 3.5 mm.

The finished fabric had the following apparent properties (initial measurements):

| | | |
|---|---|---|
| Typical free absorbency (no load) | 2050% | 20.5 g/g |
| Absorbency under load (135 g/100 cm.$^2$) | 1600% | 16 g/g |
| Absorbency under load (285 g/100 cm.$^2$) | 1500% | 15 g/g |
| Weight 165 gsm | Thickness 3.5 mm. | |

The illustrative absorbent material of a thickness as set out in this Example I has good drape and handle.

It is thought that between the layers (14) air spaces or interstices (18) are created and exist in order to contribute to the level of absorbency volume of the material through containment rather than fibre absorption: it is important in processing to ensure that the sheet material is not caused to collapse.

EXAMPLE II

Example I was repeated, as closely as possible, except that a different 1.7 dTex polyester fibre was used. This fibre was sourced from Tuntex (Thailand). This constitutes 76% of the fibre blend. It was found that the resultant fabric and properties were much the same as Example I above.

EXAMPLE III

This Example illustrates the use of a melt fibre that is not bi-component in structure. In this case an amorphous thermoformable fibre, viz. polypropylene, was used. Similar results could be obtained using other melt fibres, e.g. polyethylene and low melting point polyester.

The following blend of fibres was used:

60% by weight 1.7 dTex polyester of the Trevira type T290

20% by weight 5.0 dTex polyester, also of the Trevira T290 type

20% by weight 2.8 dTex polypropylene. This fibre constitutes the fusible fibre of the structure and has a melt temperature in the order of 160° C. The particular fibre used was Moplefan type CS2.

Alternatively, between 20–30% of the material blend may be hydrophilic fibre such as viscose with appropriate scale reduction in the constituent fibre percentages outlined below.

As with Examples I and II, these fibres were blended in the stated proportions prior to being processed through high-efficiency cards and the resultant web was cross-lapped. Tacking then took place as previously described using 40 gauge tacking needles. Thereafter the tacked web was needled in a first loom to a penetration, from top and bottom, of 8 mm. and with a punch density of 100/cm.$^2$ to give structure and strength to the material, and thereafter in Loom 2 needling took place to a penetration of 4.8 mm. (top) and 6.2 mm. (bottom) with a punch density of 300/cm.$^2$ thus to provide the denser surface layers. At this stage the web had a weight of about 170 gsm and a loft of 2.4 mm.

As in Examples I and II, the web was then through-air bonded, at a temperature of 180° C. and a dwell time of 1 minute; in this case, however, no surface-rolling took place. The throughput of air was such that the polypropylene fibres melted at least superficially to enable them to flow so that they bonded with adjacent fibres and, upon cooling, effectively locked them in position, but without collapsing the web during such heating or reducing substantially its thickness by shrinkage. After heating, the web was shock-cooled by drawing cold air therethrough. The finished product had a weight of 180 gsm and an unconstrained thickness (loft) of about 2.2 mm., with good tensile strength and a free absorbency (no load) in the order of 1200% (12 g/g).

COMPARATIVE EXAMPLE

Example I was repeated, but omitting the bi-component polyester from the blend. The blend used 80% 1.7 dTex polyester and 20% 5.0 dTex polyester. The resultant fabric, although still absorbent, showed a much reduced absorbency and physical strength.

In the case of the materials in accordance with the invention made as described in Examples I, II and III above, it has been found that despite the weakly bound nature of the material as a whole, the bonding of the fibres resists the tendency of the structure to collapse when wetted and thus reduces any tendency to "wet back". In the particular Examples, moreover, despite the hydrophobic nature of the fibres used, the absorbing properties are surprisingly good. Absorbency and retentivity are of a level normally associated with hydrophilic fabrics, e.g. those made with significant quantities of rayon or cotton which, however, as mentioned above, can be subject to wet collapse. As can be seen from the test results above, the illustrative absorbent material performs very satisfactorily when the wet material is subjected to loads.

Where the absorbent material is made entirely of hydrophobic fibres, furthermore, the surfaces thereof feel surprisingly dry even when a considerable amount of fluid is retained within the material: arises from the increased surface density of the fabric and from the tendency to preferentially wick fluid into the low density core region away from the surfaces. It is common practice in other absorbent materials to apply a separate non-woven fabric to provide such a "stay-dry" effect: this separate material may be eliminated in the case of the illustrative absorbent materials. Furthermore, by appropriate choice of needle punching density and so entanglement in the surface layers and in the low density region of the material, it is possible to take advantage of the surface tension within the liquid to further enhance wicking to the low density core region and inhibit back-flow of such liquid. Such surface tension within the air spaces (8) is arranged to promote lateral flow of the liquid in the plane of the low density core region rather than vertically back through the surface layers.

The surfaces of the surface layers (10) of the illustrative absorbent materials are relatively smooth and lint-free which are distinct advantages for fabrics for use in surgical and catamenial applications. Furthermore the illustrative materials provide good mechanical cushioning and resilience which may improve comfort in some products. It is believed that the bonding provided contributes to the increase in strength and resiliency as well as the relatively smooth surface.

An additional advantage of the illustrative absorbent materials where made entirely of hydrophobic fibres, arises in that the cost of such fibres tends to be noticeably cheaper than corresponding hydrophilic fibres, e.g. cotton and rayon, and such fibres are often easier to process.

Furthermore, absorption of fluids as occurs into hydrophilic fibres may be disadvantageous for some products, e.g. surgical, catamenial or incontinence products intended to be reused. Where materials including hydrophilic fibres are included in re-usable absorbent products which are intended to be washed before re-use, the fibres themselves absorb a certain amount of material and this material is not entirely removed from the hydrophilic fibres by washing. This can lead to residual odour and the possibility of cross-infection. Hydrophobic fibres cannot absorb aqueous, e.g. body, fluids and so washing the absorbent material is able to remove all or substantially all of the absorbed materials because the absorbed materials are absorbed purely interstitially.

Thus, in the present invention the absorbed liquid is mechanically retained rather than absorbed by chemical and/or physical bonding to hydrophilic fibres. Such non-invasive absorption of liquid obviously extends the useful life of any absorbent products made from the material. However, in the present invention, by combination of surface and low density core region layers the potential problems of compressive or squeeze release of such liquid is substantially reduced. As a consequence, a liquid absorbent material using mechanical liquid retainment is provided which is accepted for situations such as hospital bed pads where compressive or percussive forces may be present. Such containment of liquid in combination with some hydrophilic fibres ensures that the absorption quotient, i.e. weight absorbed compared to weight of absorbed material, is significantly increased.

By selective needle tacking in a manufacturing stage of production of the absorbent material, it is possible to create areas or pillars of greater entanglement through the depth of the material. Thus, by combination of the hydrophobic fibre scaffold resilience of the present invention and positioning of these areas/pillars of higher entanglement it is possible to provide structural features in the absorbent material. These structural features include, for example;

1. Channels which in combination with the application of alternating compressive force such as movement of a patient upon the material, may allow a pumping action pushing the liquid to the periphery of the material;
2. Edge sealing for the absorbent material which inhibits the lateral flow of the absorbed liquid beyond that edge,
3. Provision of discreet zones in the material which contain absorbed liquid within that zone and prevents further lateral flow of the absorbed liquid beyond the designated zone and so prevents sloshing.

These areas or pillars of increased fibre entanglement are achieved by variation of the density of needles in the tacking board of the needle tacking loom. It will be appreciated needles which are 1 cm. apart make roughly twice as many needle entanglements as compared to needles which are 2 cm. apart.

We claim:

1. An absorbent material comprising a non-woven fibre sheet having a plurality of relatively distinct layers, said non-woven sheet being arranged to have at each face a surface layer and have a region of lower density absorbent material therebetween, each surface layer having a higher compactness of fibres compared to the region of said lower density material of said absorbent material therebetween, and thus each said surface layer being of a higher density than the region of said absorbent material therebetween, said higher compactness of fibres in each said surface layer being maintained by higher tack entanglement between fibres as compared to said region of said absorbent material therebetween where the substantial majority of fibres remain in a plane parallel of the sheet, said lower density region including areas or pillars of enhanced fibre entanglement to create structures comprising channels, edge sealing or discreet zones within said material to control flow or movement of any absorbed liquid, said absorbent material being formed from a blend of fibres including a proportion of hydrophobic fibres and a proportion of activated fibrous bonding agent, said hydrophobic fibres and said activated fibrous bonding agent adhering together in a resilient voluminous structure resistant to percussive pressure, said voluminous structure having air spaces between said fibres arranged to hold liquid despite such percussive pressure.

2. An absorbent material according to claim 1 wherein the bonding agent comprises a hot melt bonding material originating as one component of a bi-component fibre, the other component remaining in fibrous form in the sheet.

3. A material according to claim 1 wherein the bonding agent is constituted by polypropylene fibres.

4. A material according to claim 1 comprising a blend of fibres comprising 5 to 40% by weight coarse deciTex fibres, i.e. of at least 5 deciTex, the balance being fine deciTex fibres of less than 3 deciTex.

5. A material according to claim 1 where the fibre layers are constituted substantially wholly by hydrophobic fibres.

6. A material according to claim 1 wherein the surface layers are less than 0.5 mm. in thickness.

7. A material according to claim 1 wherein the low density region provides at least 70% of the thickness of the sheet material.

8. A method of making an absorbent material comprising forming a non-woven fibre web comprising a blend of fibres including a minor weight of a heat-activated bonding agent in fibrous form, subjecting the web to needling at a low punch density with the needles penetrating through the web, then subjecting surface regions only of the web to needling at a much higher punch density whereby to form dense surface layers of fibres at each face of the web and a less dense layer therebetween, and thereafter subjecting the web to heat in such a manner as to activate the bonding agent and cause it to bond to adjacent fibres but without destroying its fibrous structure and without substantially affecting the other fibres of the web and without causing significant shrinkage, said less dense region including areas or pillars of enhanced fibre entanglement to create structures comprising channels, edge sealing or discreet zones within said material to control flow or movement of any absorbed liquid.

9. A method according to claim 8 wherein the web is subjected to heat by passing hot air through the web in sufficient volume and for a suitable period of time.

10. A method according to claim 9 comprising passing the web, after subjecting the web to heat, between rolls set at a fixed gap.

11. A method according to claim 9 wherein the web is cooled after having been subjected to heat by passing cool air through the web.

12. A method according to claim 8 wherein the low punch density is from ½ to 20 per $cm.^2$ and the high punch density from 100 to 1,000 per $cm.^2$.

* * * * *